US005785502A

United States Patent [19]

Ota et al.

[11] Patent Number: 5,785,502

[45] Date of Patent: Jul. 28, 1998

[54] CONTROL APPARATUS FOR VARIABLE DISPLACEMENT COMPRESSOR

[75] Inventors: Masaki Ota; Sokichi Hibino; Hisakazu Kobayashi; Masahiro Kawaguchi; Ken Suitou; Koji Kawamura; Takuya Okuno, all of Kariya, Japan

[73] Assignee: Kabushiki Kaisha Toyoda Jidoshokki Seisakusho, Kariya, Japan

[21] Appl. No.: 540,556

[22] Filed: Oct. 6, 1995

[30] Foreign Application Priority Data

Oct. 11, 1994 [JP] Japan ..... 6-245625

[51] Int. Cl.[6] ..... F04B 1/26

[52] U.S. Cl. ..... 417/222.2; 417/222.1; 417/270

[58] Field of Search ..... 417/222.2, 222.1, 417/270

[56] References Cited

U.S. PATENT DOCUMENTS 5,173,032 12/1992 Taguchi et al. ..... 417/222.2
5,529,461 6/1996 Kawaguchi et al. ..... 417/222.2
5,586,870 12/1996 Kawaguchi et al. ..... 417/222.2
5,603,610 2/1997 Kawaguchi et al. ..... 417/222.2
5,624,240 4/1997 Kawaguchi et al. ..... 417/222.2

*Primary Examiner*—Timothy Thorpe
*Assistant Examiner*—Cheryl J. Tyler
*Attorney, Agent, or Firm*—Brooks Haidt Haffner & Delahunty

[57] ABSTRACT

A swash plate tiltably supported on a drive shaft is controlled by adjusting the pressure in a crank chamber. When an electromagnetic valve is de-excited, the high-pressure refrigerant gas in a discharge chamber is supplied to the crank chamber so that the inclination angle of the swash plate is shifted to its minimum inclination from its maximum inclination. An open/close mechanism located in a suction passage gradually opens or closes the suction passage in accordance with the differential pressure between the pressure in the external refrigeration circuit located upstream the open/close mechanism and the pressure in a suction chamber. When the inclination angle of the swash plate is minimized, the open/close mechanism closes the suction passage. It is therefore possible to prevent frosting while also suppressing rapid changes in load torque.

16 Claims, 13 Drawing Sheets

CONTROL APPARATUS FOR VARIABLE DISPLACEMENT COMPRESSOR

BACKGROUND OF THE INVENTION

1. Field of the Invention

The present invention relates to a control apparatus for switching between a state for inhibiting the circulation of refrigerant in an external refrigeration circuit and a state of allowing the circulation of refrigerant in a variable displacement compressor which supplies pressure to a control pressure chamber from a discharge pressure area and discharges pressure to a suction pressure area to thereby vary the displacement.

2. Description of the Related Art

Ordinary compressors have a clutch, e.g., an electromagnetic clutch, provided between the drive shaft and an external driving source to permit or block power transmission. Recently, a clutchless variable displacement type rocking swash plate compressor which uses no electromagnetic clutch has been proposed. This type of compressor, particularly when mounted on a vehicle, removes shocks produced by the ON/OFF action of the electromagnetic clutch, thus eliminating passenger discomfort. This clutchless structure also reduces the overall weight and cost.

Such a clutchless compressor, however, fails to cope with a change in discharge displacement when no cooling is needed and with the occurrence of frosting in the evaporator in the external refrigeration circuit. To overcome those problems, the circulation of the refrigerant gas through the external refrigeration circuit should simply be stopped when no cooling is needed. Japanese Unexamined Patent Publication No. Hei 3-37378 discloses a compressor which is designed to block the flow of refrigerant gas into the suction chamber from the external refrigeration circuit, thereby stopping the circulation of the refrigerant in the external refrigeration circuit.

When the circulation of the gas from the external refrigeration circuit to the suction chamber in this compressor is blocked, the pressure in the suction chamber drops and the displacement control valve responsive to that pressure opens fully. The full opening of the control valve allows the gas in the discharge chamber to flow into the crank chamber, which in turn raises the pressure inside the crank chamber. The reduced pressure in the suction chamber also reduces the suction pressure in the cylinder bores. Therefore, the difference between the pressure in the crank chamber and the suction pressure in the cylinder bores increases to minimize the inclination of the swash plate. As a result, the discharge displacement becomes minimum. At this time, the driving torque needed by the compressor is minimized, thus reducing power loss as much as possible when no cooling is needed.

The flow of the refrigerant gas toward the suction chamber in the compressor from the external refrigeration circuit is blocked by closing an electromagnetic valve. This electromagnetic valve performs a simple ON/OFF action, and the checking of the gas flow from the external circuit to the suction chamber is executed spontaneously. Accordingly, the amount of gas led into the cylinder bores from the suction chamber decreases drastically. The rapid reduction in the amount of gas led into the cylinder bores quickly reduces the discharge displacement, causing the discharge pressure to fall sharply. Consequently, the torque needed by the compressor varies in a short period of time.

Further, the gas flow from the external circuit to the suction chamber restarts also instantaneously when the electromagnetic valve is opened. The amount of gas supplied into the cylinder bores from the suction chamber increases rapidly. This sharp increase in the amount of refrigerant gas promptly increases the discharge displacement, raising the discharge pressure. Consequently, the torque needed by the compressor sharply rises in a short period of time.

SUMMARY OF THE INVENTION

Accordingly, it is a primary objective of the present invention to suppress a variation in torque in a variable displacement compressor.

To achieve the foregoing and other objects and in accordance with the purpose of the present invention, a displacable compressor is provided. A displacable compressor includes a suction portion and a discharge portion, the suction portion and the discharge portion being connected with each other by way of a fluid passage. To compress fluid introduced to the fluid passage from the suction portion and to discharge the compressed fluid from the discharge portion to the fluid passage, the fluid circulating in the fluid passage changes pressure thereof. The fluid passage has a first point and a second point to define an area therebetween. First means are disposed in the area to selectively open and close the fluid passage in accordance with a difference between the pressures at the first point and the second point. Second means are provided for actuating the first means to close the fluid passage when the pressure difference is smaller than a predetermined value.

BRIEF DESCRIPTION OF THE DRAWINGS

The features of the present invention that are believed to be novel are set forth with particularity in the appended claims. The invention, together with objects and advantages thereof, may best be understood by reference to the following description of the presently preferred embodiments together with the accompanying drawings in which:

DETAILED DESCRIPTION OF THE PREFERRED EMBODIMENTS

The first embodiment of the present invention will be now described with reference to FIGS. 1 through 6.

Figure 1:
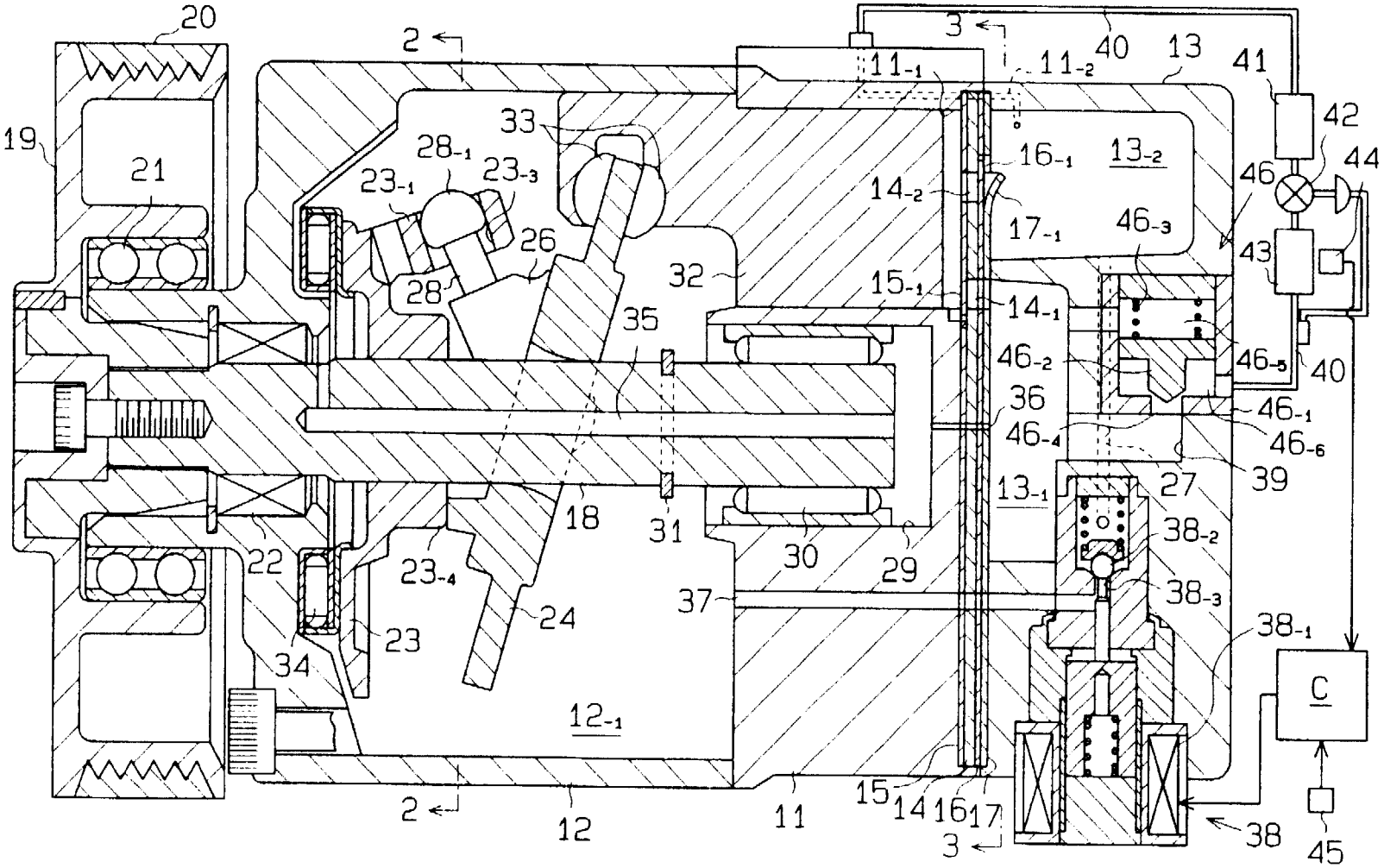
FIG. 1 is a side cross-sectional view showing the overall structure of a clutchless variable displacement compressor according to a first embodiment of the present invention.

As shown in FIG. 1, a front housing 12 is secured to the front end of a cylinder block 11, which is a part of the housing of the compressor. A rear housing 13 is secured to the rear end of the cylinder block 11 via a valve plate 14, valve-forming plates 15 and 16, and a retainer-forming plate 17. The front housing 12 and the cylinder block 11 define a crank chamber 12-1 which serves as a control pressure chamber. A drive shaft 18 is rotatably supported between the front housing 12 and the cylinder block 11. The front end of the drive shaft 18 protrudes outside the crank chamber 12-1, with a driven pulley 19 secured to this front end. The driven pulley 19 is coupled to a vehicle's engine (not shown) via a belt 20. The engine serves as the driving source for supplying the rotational driving force to the compressor. The driven pulley 19 is supported on the front housing 12 via an angular bearing 21.

Figure 2:
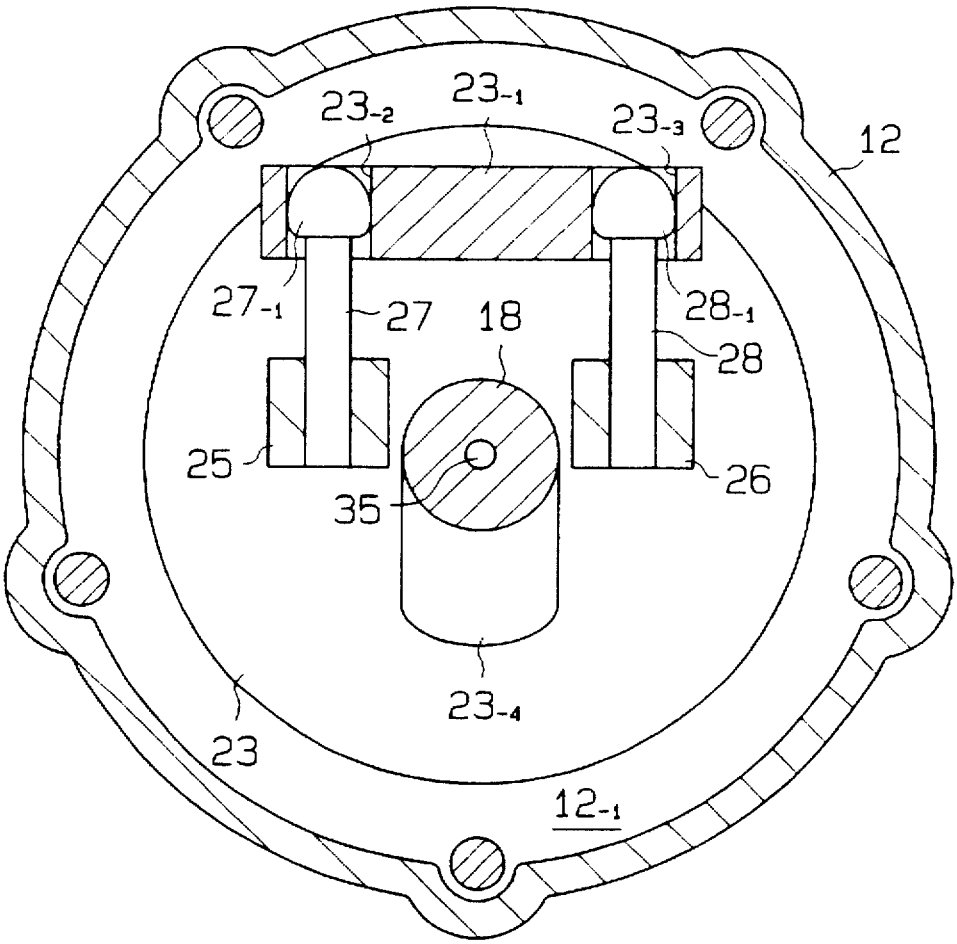
FIG. 2 is a cross-sectional view taken along the line 2—2 in FIG. 1.

Between the front end of the drive shaft 18 and the front housing 12 is a lip seal 22 which prevents the pressure leakage from the crank chamber 12-1. A rotational support 23 is attached to the drive shaft 18 on which a swash plate 24 is supported in such a way as to be slidable and tiltable in the axial direction of the drive shaft 18. As shown in FIG. 2, stays 25 and 26 are secured to the swash plate 24, with a pair of guide pins 27 and 28, respectively, secured to the stays 25 and 26. Guide balls 27-1 and 28-1 are formed at the distal ends of the guide pins 27 and 28. A support arm 23-1 extends from the rotational support 23. The support arm 23-1 has a pair of guide holes 23-2 and 23-3 in which the guide balls 27-1 and 28-1 are slidably fitted.

Figure 4:
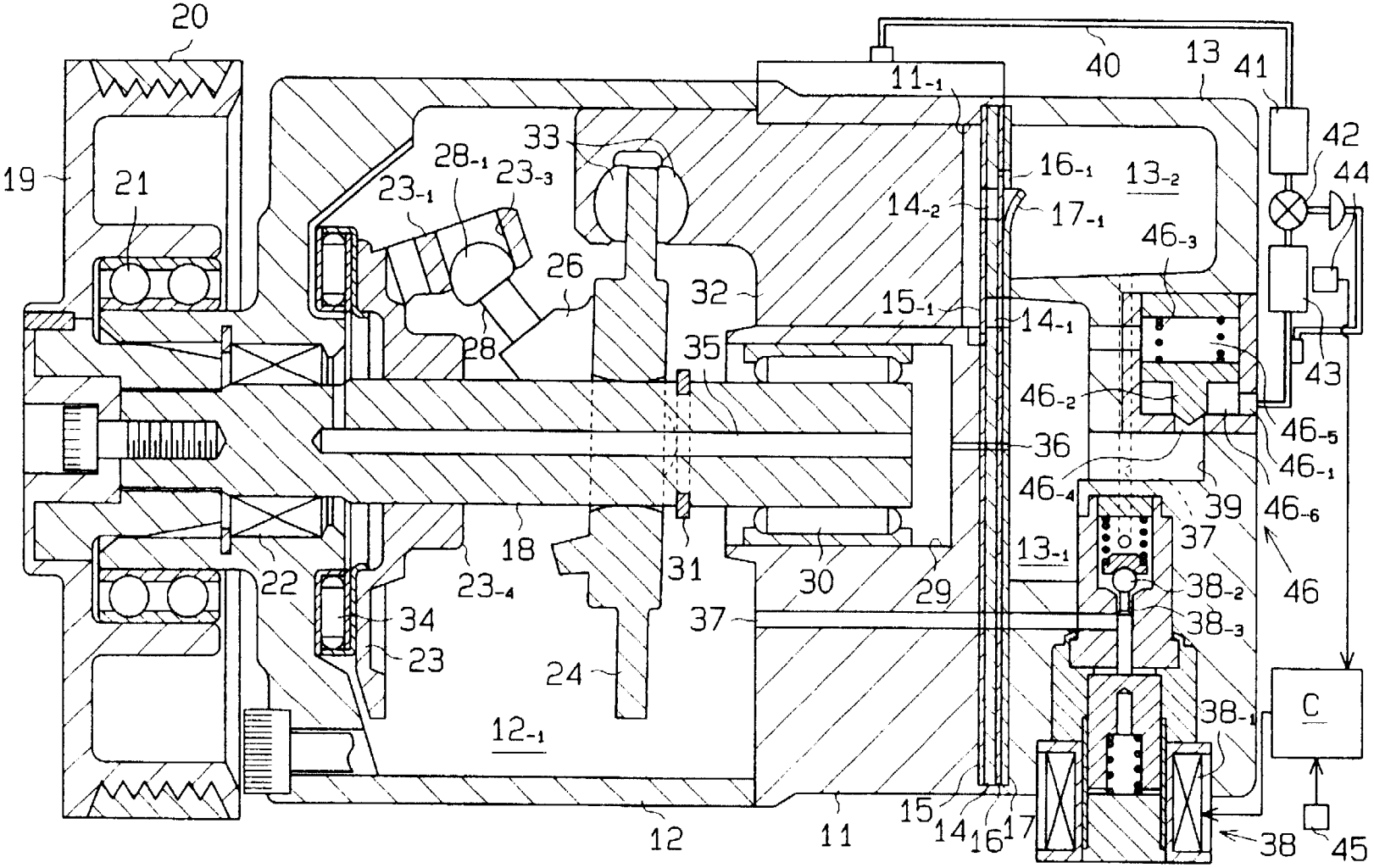
FIG. 4 is a side cross-sectional view of the whole variable displacement compressor whose swash plate is at the minimum inclined angle.
Figure 5:
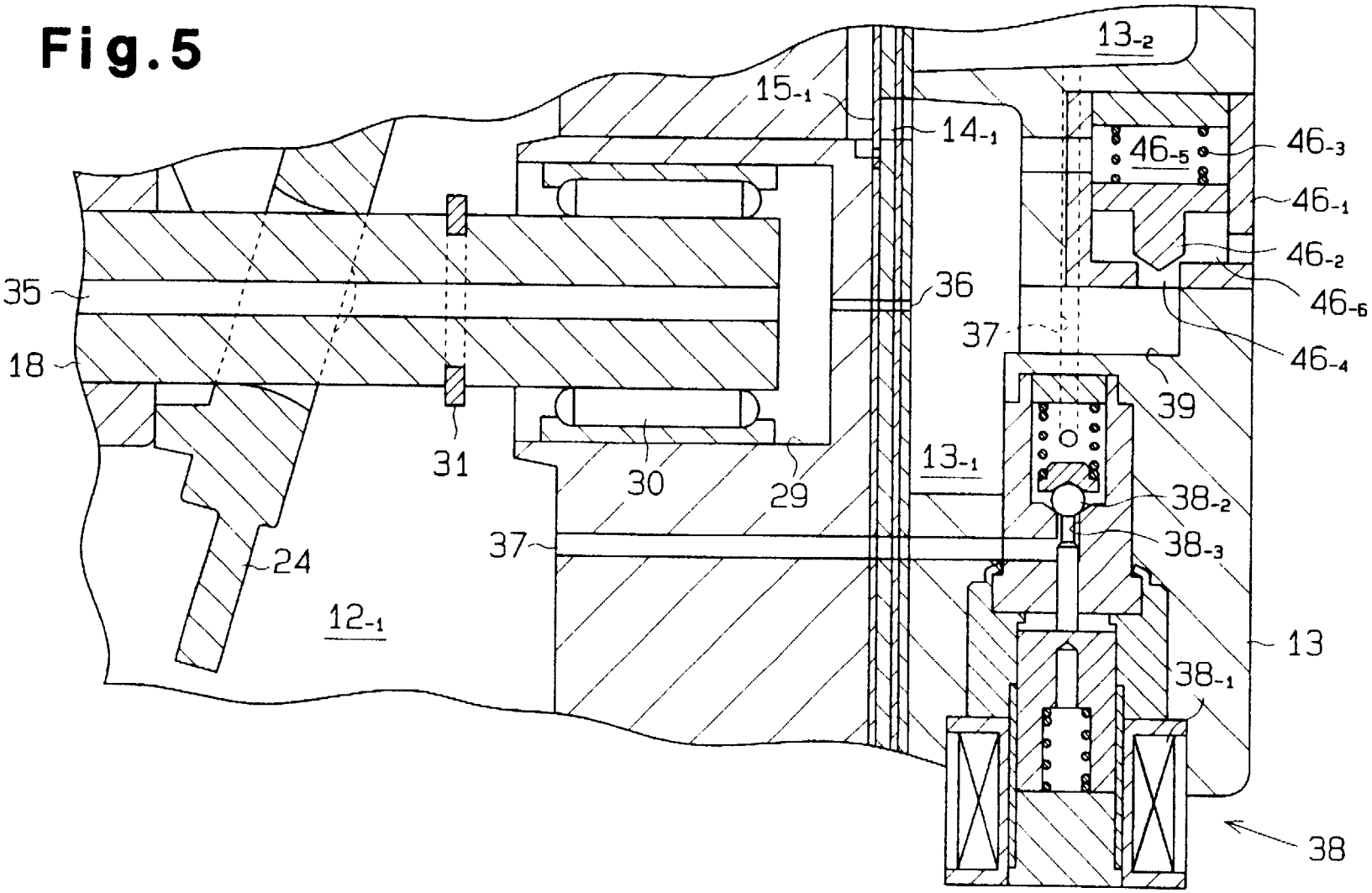
FIG. 5 is an enlarged side cross-sectional view of the essential parts of the compressor whose swash plate is at the maximum inclined angle.

As shown in FIGS. 1, 4 and 5, a support hole 29 is formed in the center portion of the cylinder block 11 in the axial direction of the drive shaft 18. One end of the drive shaft 18 is rotatably supported in the support hole 29 via a radial bearing 30.

The coupling of the support arm 23-1 and the guide pin pair 27 and 28 allows the swash plate 24 to incline in the axial direction of the drive shaft 18 and rotate together with the drive shaft 18. The inclination of the swash plate is determined by the support arm 23-1, the guide pins 27 and 28 and the drive shaft 18.

The minimum inclined angle of the swash plate 24 is slightly greater than zero degrees. This minimum inclination state is established by the abutment of the swash plate 24 against a position restricting ring 31 which serves as minimum inclination restricting means. The maximum inclined angle of the swash plate 24 is restricted by the abutment of an inclination restricting projection 23-4 of the rotational support 23 on the swash plate 24.

A plurality of cylinder bores 11-1 which communicate with the crank chamber 12-1 are formed through the cylinder block 11, and single-headed pistons 32 are retained in the respective cylinder bores 11-1. Rotational motion of the swash plate 24 is converted to forward and backward movement of the single-headed pistons 32 via shoes 33, so that the pistons reciprocate in the associated cylinder bores 11-1.

Figure 3:
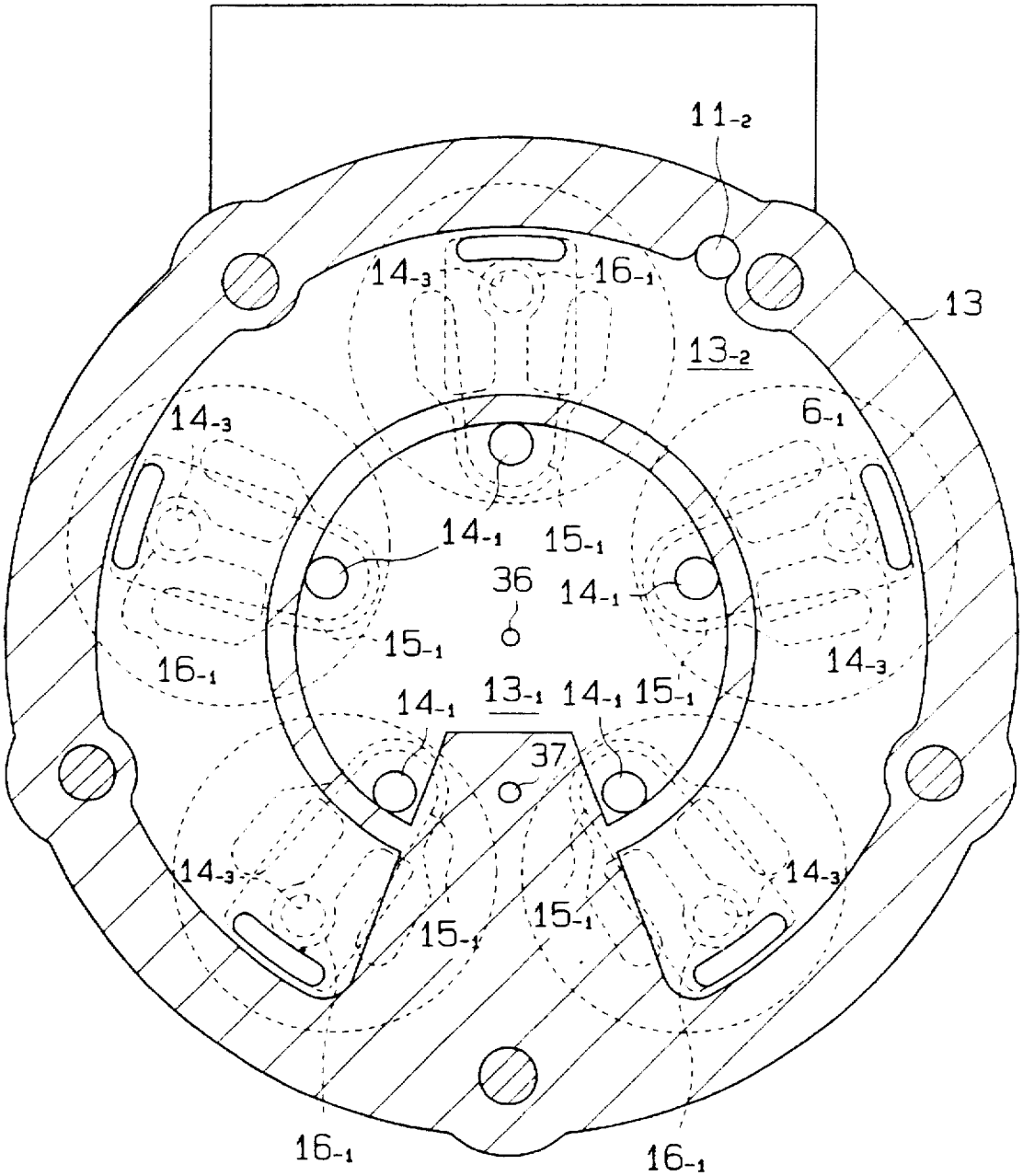
FIG. 3 is a cross-sectional view taken along the line 3—3 in FIG. 1.

As shown in FIGS. 1 and 3, a suction chamber 13-1 and a discharge chamber 13-2 are defined in the rear housing 13. Suction ports 14-1 and discharge ports 14-2 are formed in the valve plate 14. Suction valves 15-1 are formed on the valve-forming plate 15, and discharge valves 16-1 on the valve-forming plate 16. As the single-headed pistons 32 move backward, the refrigerant gas in the suction chamber 13-1 forces the suction valves 15-1 open through the suction ports 14-1 and enters the cylinder bores 11-1. As the pistons 32 move forward, the refrigerant gas in each cylinder bore 11-1 forces the associated discharge valve 16-1 open through the associated discharge port 14-2 and enters the discharge chamber 13-2. As each discharge valve 15-2 abuts on a retainer 17-1 on the retainer-forming plate 17, the amount of opening of the associated discharge port 14-2 is restricted.

A thrust bearing 34 is located between the rotational support 23 and the front housing 12. This thrust bearing 34 receives the compressive reaction force from the cylinder bores 11-1 that acts on the rotational support 23 via the single-headed pistons 32, shoes 33, the swash plate 24, the stays 25 and 26 and the guide pins 27 and 28.

The drive shaft 18 has a pressure release passage 35 formed inside, which communicates with the crank chamber 12-1 and the support hole 29. The support hole 29 and the suction chamber 13-1 communicate with each other via a restriction passage 36.

As shown in FIGS. 1 and 4, the discharge chamber 13-2 and the crank chamber 12-1 communicate with each other via a pressure supply passage 37 in which an electromagnetic valve 38, which forcibly restricts the inclination of the swash plate, is located. The electromagnetic valve 38 has a solenoid 38-1 and a valve body 38-2. When the solenoid 38-1 is excited, the valve body 38-2 closes a valve hole 38-3, and when the solenoid 38-1 is de-excited, the valve body 38-2 opens the valve hole 38-3. That is, the electromagnetic valve 38 opens and closes the pressure supply passage 37 that allows the discharge chamber 13-2 and the crank chamber 12-1 to communicate with each other.

A suction passage 39 for leading the refrigerant gas into the suction chamber 13-1 is connected to a discharge passage 11-2 for discharging the refrigerant gas from the discharge chamber 13-2 by an external refrigeration circuit 40. Located in the external refrigeration circuit 40 are a condenser 41, an expansion valve 42 and an evaporator 43. The expansion valve 42 controls the flow of the refrigerant gas in accordance with the gas pressure on the outlet side of the evaporator 43. A temperature sensor 44 is provided in the vicinity of the evaporator 43 to sense the temperature in the evaporator 43. The information on the detected temperature is sent to a control computer C.

The control computer C, which is the refrigerant circulation controller, controls the excitation and de-excitation of the solenoid 38-1 based on the temperature detected by the temperature sensor 44. When the detected temperature falls to or below a set temperature, the control computer C instructs the de-excitation of the solenoid 38-1 while an air-conditioner activation switch 45 is set ON. The set temperature is set on the reflection of the situation where frosting may occur in the evaporator 43.

An open/close mechanism 46 is provided in the suction passage 39. A valve body 46-2 in a valve housing 46-1 is urged in the direction to close a valve hole 46-4 by means of an adjusting spring 46-3. The valve body 46-2 separates the interior of the valve housing 46-1 into a compression-sensing chamber 46-5 and a leading chamber 46-6. The compression-sensing chamber 46-5 communicates with the suction chamber 13-1, and the leading chamber 46-6 communicates with the external refrigeration circuit 40. The pressure inside the compression-sensing chamber 46-5 and the elastic force of the adjusting spring 46-3 are applied to the compression-sensing chamber (46-5) side of the valve body 46-2, and the pressure inside the leading chamber 46-6 is applied to the leading chamber (46-6) side of the valve body 46-2. The valve body 46-2 opens or closes the valve hole 46-4 in accordance with the pressure difference between the urging force on the compression-sensing chamber (46-5) side and the urging force on the leading chamber (46-6) side.

As shown in FIGS. 1 and 5, when the solenoid 38-1 is excited, the pressure supply passage 37 is closed. Therefore, the high-pressure refrigerant gas is not supplied to the crank chamber 12-1 from the discharge chamber 13-2, and the refrigerant gas inside the crank chamber 12-1 flows out to the suction chamber 13-1 via the pressure release passage 35 and the restriction passage 36. As a result, the pressure in the crank chamber 12-1 approaches the pressure inside the suction chamber 13-1 or the suction pressure, and the inclination of the swash plate 24 is kept at a maximum to ensure the maximum discharge displacement.

The pressure in the leading chamber 46-6 which communicates with the external refrigeration circuit 40 located upstream of the suction passage 39 is greater than the pressure in the compression-sensing chamber 46-5 which communicates with the suction chamber 13-1 located downstream the suction passage 39. The greater the discharge displacement becomes, the greater the amount of refrigerant gas flowing in the external refrigeration circuit 40 becomes and the larger the difference between the pressure in the external refrigeration circuit 40 located upstream of the suction passage 39 and the pressure in the suction chamber 13-1 located downstream the suction passage 39 becomes. With a large discharge displacement, the pressure in the leading chamber 46-6 is greater than the sum of the pressure in the compression-sensing chamber 46-5 and the elastic force of the adjusting spring 46-3, so that the valve body 46-2 opens the valve hole 46-4. When the electromagnetic valve 38 is excited, the circulation of the refrigerant gas in the external refrigeration circuit 40 is permitted.

When the swash plate 24 keeps the maximum inclination with a low cooling load to effect the discharging action, the temperature in the evaporator 43 approaches the level at which frosting occurs. The temperature sensor 44 has sent the information of the detected temperature in the evaporator to the control computer C. When the detected temperature becomes equal to or lower than the set temperature, the control computer C instructs the de-excitation of the solenoid 38-1. When the solenoid 38-1 is de-excited, the pressure supply passage 37 is open, connecting the discharge chamber 13-2 to the crank chamber 12-1. Therefore, the high-pressure refrigerant gas in the discharge chamber 13-2 is supplied via the pressure supply passage 37 to the crank chamber 12-1, raising the pressure inside the crank chamber 12-1. This pressure increase shifts the swash plate 24 toward the minimum inclination position.

Figure 6:
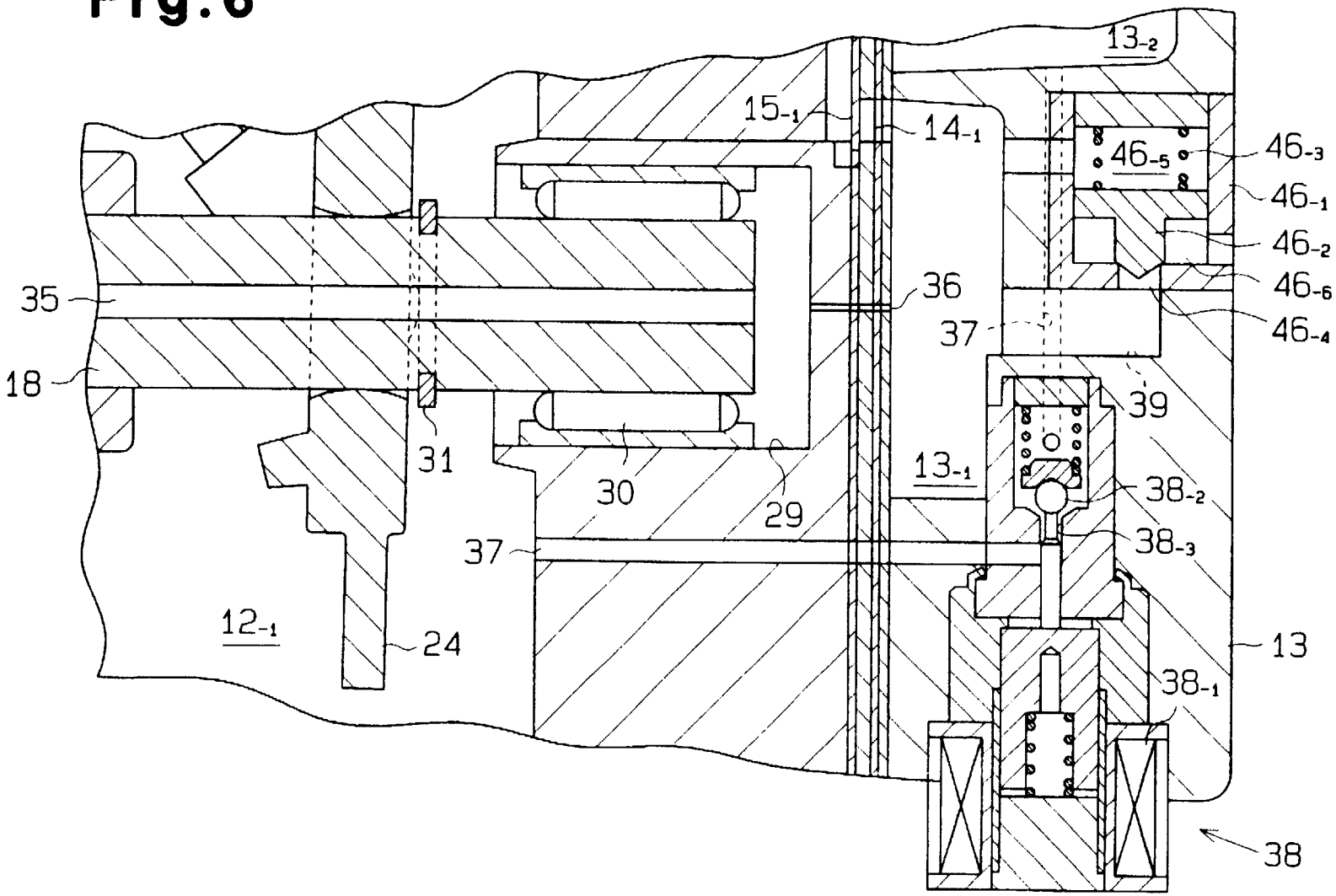
FIG. 6 is an enlarged side cross-sectional view of the essential parts of the compressor whose swash plate is at the minimum inclined angle.

When the swash plate 24 abuts on the position restricting ring 31, as shown in FIGS. 4 and 6, the inclination angle of the swash plate 24 becomes minimum. Under this minimum inclination status, the discharge displacement becomes minimum and so does the amount of refrigerant gas flowing in the external refrigeration circuit 40. With the minimum flow rate of the refrigerant gas, the difference between the pressure in the compression-sensing chamber 46-5 and the pressure in the leading chamber 46-6 becomes slight and the sum of the pressure in the compression-sensing chamber 46-5 and the spring force of the adjusting spring 46-3 exceeds the pressure in the leading chamber 46-6. As a result, the valve body 46-2 closes the valve hole 46-4. When the electromagnetic valve 38 is de-excited, therefore, the circulation of the refrigerant gas in the external refrigeration circuit 40 is inhibited.

In other words, the excitation instruction from the control computer C means the sending of a refrigerant-circulation instructing signal, and the electromagnetic valve 38, when excited, permits the circulation of the refrigerant gas in the external refrigeration circuit 40. The de-excitation instruction from the control computer C means the disabling of the refrigerant-circulation instructing signal, and the electromagnetic valve 38, when de-excited, inhibits the circulation of the refrigerant gas in the external refrigeration circuit 40.

As the minimum inclination angle of the swash plate 24 is not zero degrees, the refrigerant gas is discharged to the discharge chamber 13-2 from each cylinder bore 11-1 even with this minimum inclination angle. The refrigerant gas discharged to the discharge chamber 13-2 from each cylinder bore 11-1 flows through the pressure supply passage 37 to the crank chamber 12-1. The refrigerant gas in the crank chamber 12-1 flows through the pressure release passage 35 and the restriction passage 36 to the suction chamber 13-1. The refrigerant gas in the suction chamber 13-1 is drawn into the cylinder bores 11-1 to be discharged to the discharge chamber 13-2. That is, with the minimum inclination angle of the swash plate 24, the circulation passage connecting the discharge chamber 13-2, the pressure supply passage 37, the crank chamber 12-1, the pressure release passage 35, the restriction passage 36, the suction chamber 13-1 and the cylinder bores 11-1 is formed in the compressor, and the lubricating oil which flows together with the refrigerant gas lubricates the interior of the compressor. Differential pressures are produced among the discharge chamber 13-2, the crank chamber 12-1 and the suction chamber 13-1.

When the cooling load increases from the state shown in FIG. 6, this increase in cooling load appears as a rise in temperature in the evaporator 43 so that the temperature detected by the temperature sensor 44 exceeds the set temperature. Based on this change in detected temperature, the control computer C instructs the excitation of the solenoid 38-1. Consequently, the solenoid 38-1 is excited to close the pressure supply passage 37, so that the pressure in the crank chamber 12-1 is released through the pressure release passage 35 and the restriction passage 36 to become lower. This pressure reduction shifts the swash plate 24 toward the maximum inclination position from the minimum inclination position.

When the inclination of the swash plate 24 increases, the amount of refrigerant gas drawn into the cylinder bores 11-1 from the suction chamber 13-1 increases, rapidly reducing the pressure in the suction chamber 13-1. Consequently, the pressure in the compression-sensing chamber 46-5 also drops so that the pressure in the leading chamber 46-6 becomes greater than the sum of the pressure in the compression-sensing chamber 46-5 and the spring force of the adjusting spring 46-3. As a result, the valve body 46-2 opens the valve hole 46-4 to re-start the circulation of the refrigerant gas in the external refrigeration circuit 40.

The opening/closing of the valve hole 46-4 by the valve body 46-2 is accomplished by the shift of the differential pressure in the external refrigeration circuit between the upstream and downstream of the open/close mechanism 46 from the set value that is determined by the spring force of the adjusting spring 46-3. In other words, the opening/closing of the valve hole 46-4, unlike in the electromagnetic opening/closing, is not the ON/OFF action and the cross-sectional area of the valve hole 46-4 through which the refrigerant gas passes changes gradually. Accordingly, the amount of refrigerant gas drawn into the cylinder bores 11-1 from the suction chamber 13-1 increases slowly, and the discharge displacement increases gradually. Consequently, the discharge pressure gradually changes, thus preventing the load torque needed by the compressor from significantly changing in a short period of time. Because the load torque in the compressor does not change rapidly, the shock reduction, which is the primary aim of the clutchless compressor, is accomplished.

According to this embodiment, one of two pressure points in the external refrigeration circuit for controlling the opening/closing of the open/close mechanism 46 is located upstream of this mechanism 46 and the other pressure point is located downstream of the mechanism 46. This pressure-leading structure has such an advantage that the passage for leading the pressure to the open/close mechanism 46 can be made shortest.

Figure 7:
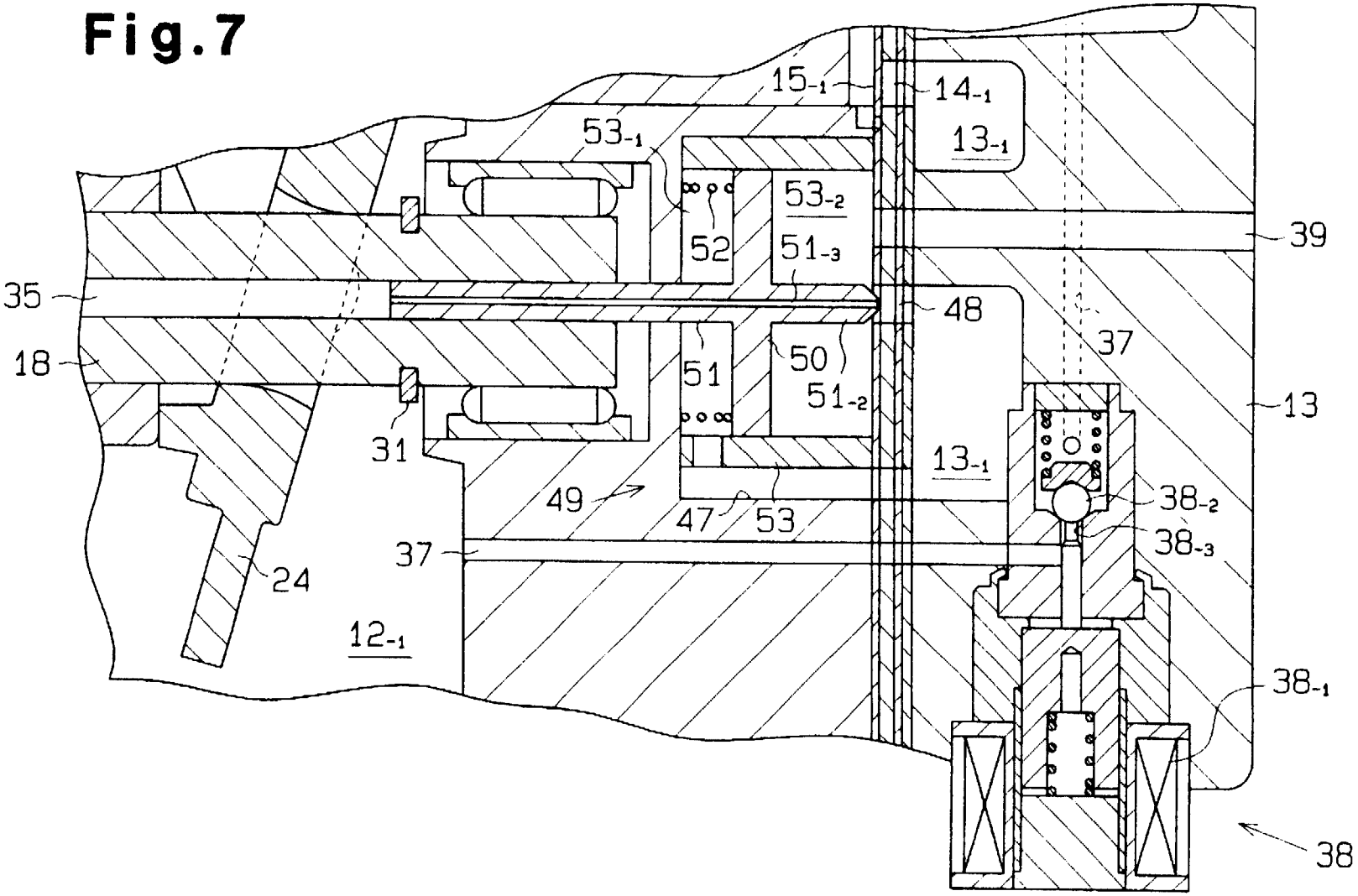
FIG. 7 is an enlarged side cross-sectional view of the essential parts of another embodiment.

An embodiment illustrated in FIG. 7 will be now described. In this embodiment, a retaining chamber 47 is formed in the cylinder block 11. The retaining chamber 47 communicates with the external refrigeration circuit 40 via the suction passage 39. The retaining chamber 47 also communicates with the suction chamber 13-1 via a port 48. An open/close mechanism 49 is accommodated in the retaining chamber 47, and a valve body 50 in a valve housing 53. The valve body 50 has a rod portion 51 whose tail portion is slidably inserted in the cylinder block 11. The rod portion 51 has a head 51-2, which is insertable in the port 48, and an axial center portion through which a restriction passage 51-3 is bored.

The valve body 50 separates the interior of the valve housing 53 into a compression-sensing chamber 53-1 and a leading chamber 53-2. The compression-sensing chamber 53-1 communicates with the suction chamber 13-1 via the retaining chamber 47, and the leading chamber 53-2 communicates with the suction passage 39. The valve body 50 is urged in the direction to close the port 48 by an adjusting spring 52 located in the compression-sensing chamber 49-1. The differential pressure between the pressure in the suction passage 39 and the pressure in the suction chamber 13-1 changes in accordance with the amount of circulating refrigerant gas.

When the electromagnetic valve 38 is excited, the inclination angle of the swash plate 24 becomes maximum as in the first embodiment. When the swash plate 24 is at the maximum inclination angle, the difference between the pressure in the compression-sensing chamber 53-1 and the pressure in the leading chamber 53-2 is large, and the valve body 50 opens the port 48. When the electromagnetic valve 38 is de-excited, the inclination angle of the swash plate 24 is minimized, reducing the differential pressure between the pressure in the compression-sensing chamber 53-1 and the pressure in the leading chamber 53-2. As a result, the valve body 50 closes the port 48 to block the circulation of the refrigerant gas in the external refrigeration circuit 40. Even with the circulation of the refrigerant gas inhibited, the restriction passage 51-3 connects the crank chamber 12-1 to the suction chamber 13-1, so that the refrigerant gas circulates through the passage that links the discharge chamber 13-2, the crank chamber 12-1, the suction chamber 13-1 and the cylinder bores 11-1. When the electromagnetic valve 38 is excited, the inclination angle of the swash plate 24 changes to the maximum angle from the minimum angle, allowing the valve body 50 to open the port 48 as in the first embodiment.

This embodiment, like the first embodiment, also executes the opening/closing of the open/close mechanism 49 in accordance with the amount of circulating refrigerant gas, and was the advantage of suppressing the switching-oriented shocks and the advantage of permitting the formation of the shortest passage for leading the pressure to the open/close mechanism 49.

Figure 8:
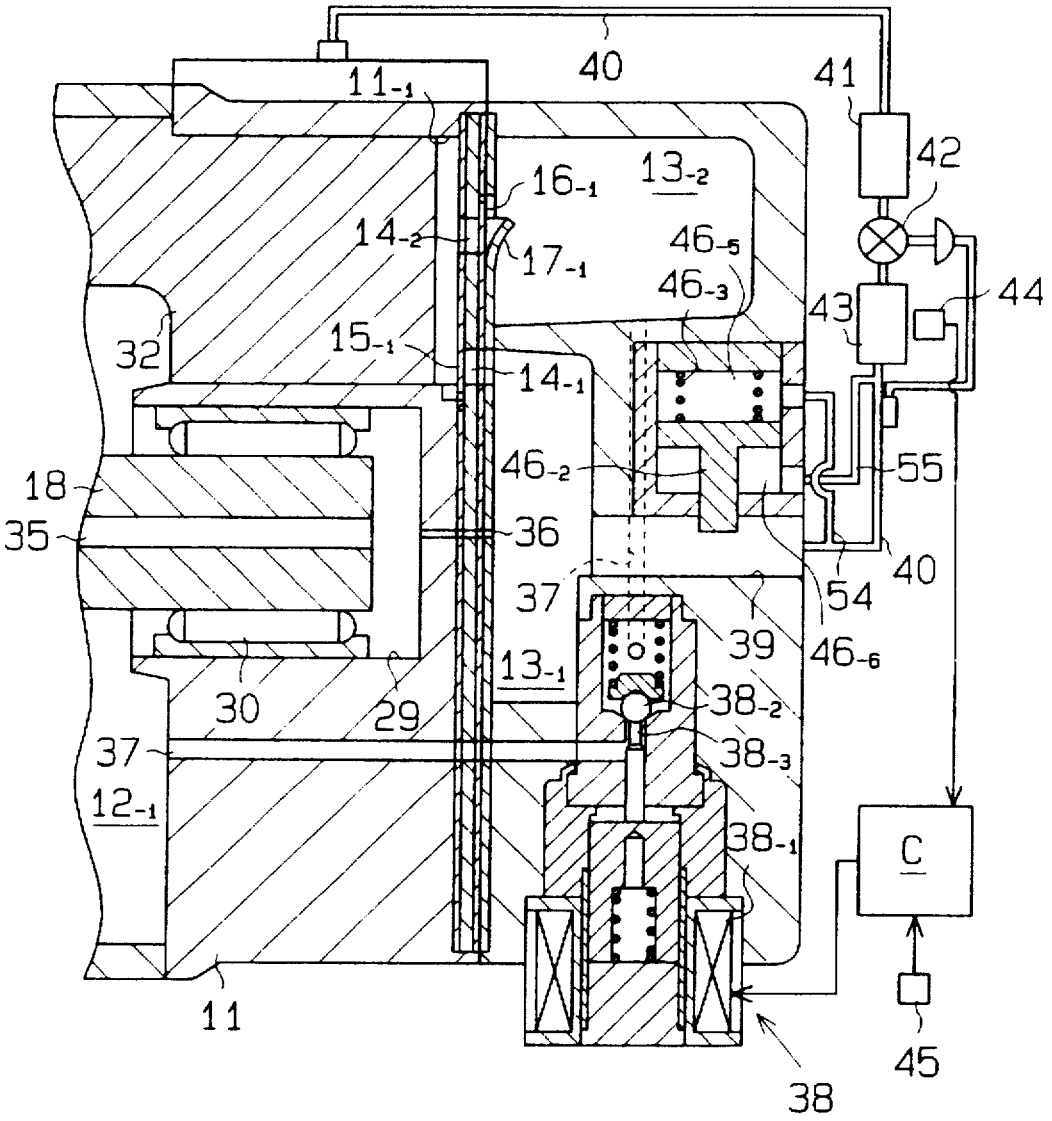
FIG. 8 is a side cross-sectional view of the essential parts of a different embodiment.

An embodiment illustrated in FIG. 8 will be now described. In this embodiment, the compression-sensing chamber 46-5 of the open/close mechanism 46 communicates via a pressure leading pipe 54 to the external refrigeration circuit 40 located downstream the evaporator 43. The leading chamber 46-6 communicates via a pressure leading pipe 55 with the external refrigeration circuit 40 upstream the position where the pressure leading pipe 54 is connected to the external refrigeration circuit 40. The valve body 46-2 of the open/close mechanism 46 opens or closes the suction passage 39.

The pressure at the connection between the pressure leading pipe 55 and the external refrigeration circuit 40 is higher than the pressure at the connection between the pressure leading pipe 54 and the external refrigeration circuit 40, and the differential pressure therebetween changes in accordance with a change in the amount of the circulating refrigerant gas. In this embodiment, the opening/closing of the open/close mechanism 49 is also executed in accordance with the amount of the circulating refrigerant gas, and the advantage of suppressing the switching-oriented shocks can be obtained as in the first embodiment.

Figure 9:
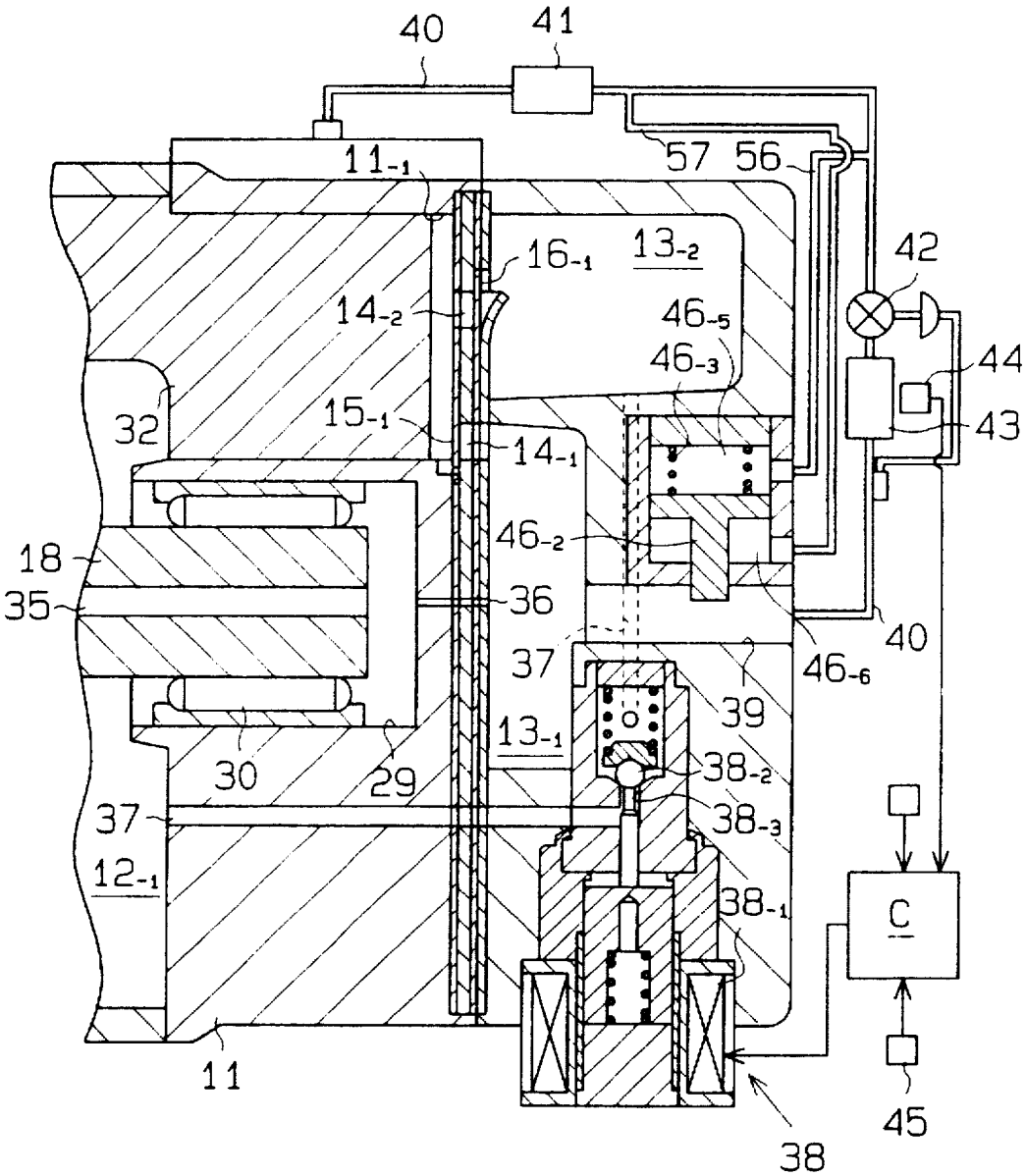
FIG. 9 is a side cross-sectional view of the essential parts of a further embodiment.

An embodiment illustrated in FIG. 9 will be now described. In this embodiment, the compression-sensing chamber 46-5 of the open/close mechanism 46 communicates via a pressure leading pipe 56 to the external refrigeration circuit 40 between the condenser 41 and the expansion valve 42. The leading chamber 46-6 communicates via a pressure leading pipe 57 with the external refrigeration circuit 40 upstream of the position where the pressure leading pipe 56 is connected to the external refrigeration circuit 40. The valve body 46-2 of the open/close mechanism 46 opens or closes the suction passage 39.

The pressure at the connection between the pressure leading pipe 57 and the external refrigeration circuit 40 is higher than the pressure at the connection between the pressure leading pipe 56 and the external refrigeration circuit 40, and the differential pressure therebetween changes in accordance with a change in the amount of circulating refrigerant gas. In this embodiment, the opening/closing of the open/close mechanism 49 is also executed in accordance with the amount of circulating refrigerant gas, and the advantage of suppressing the switching-oriented shocks are obtained as in the first embodiment.

Figure 10:
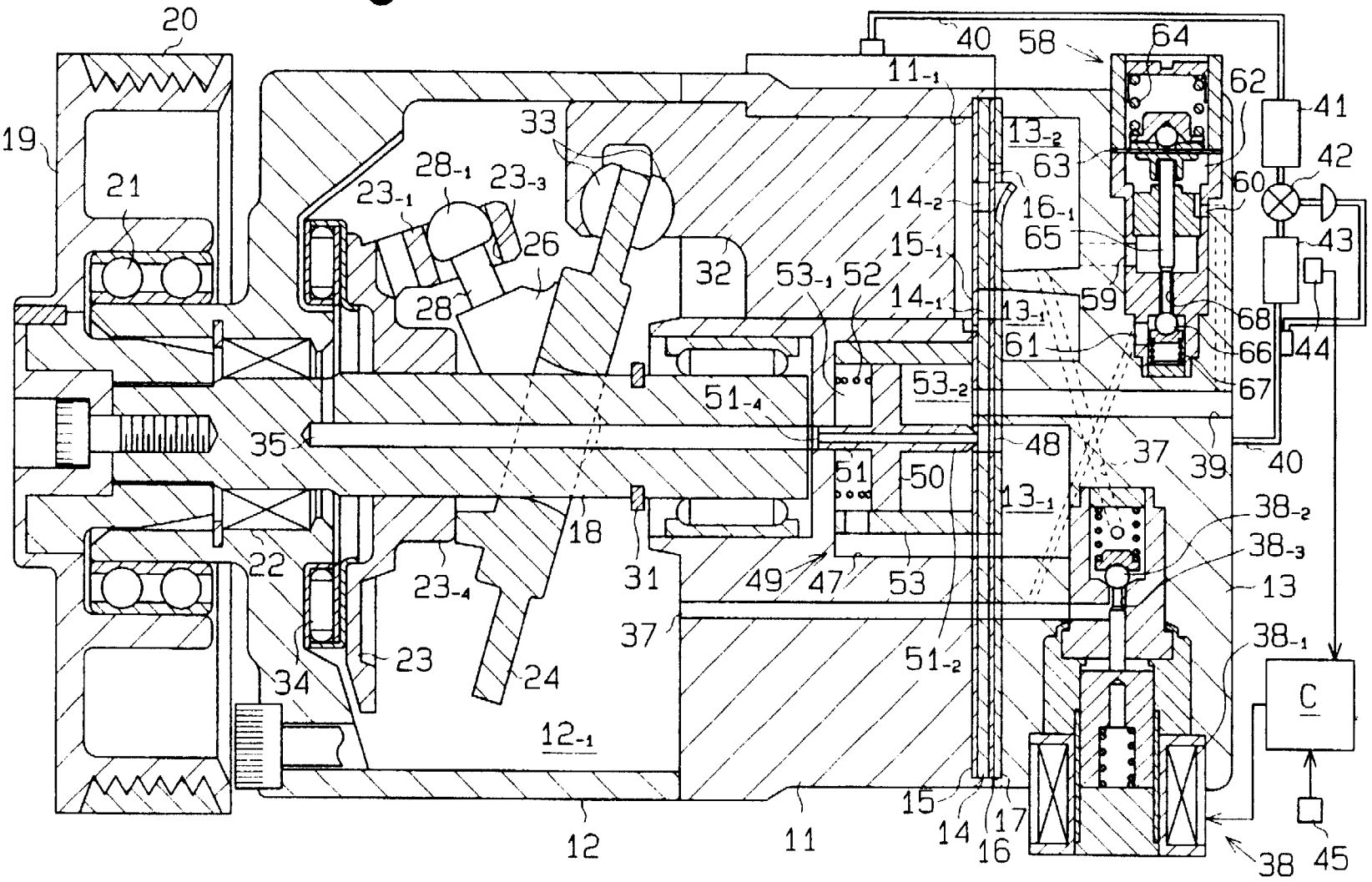
FIG. 10 is a side cross-sectional view showing the overall structure of a clutchless variable displacement compressor according to a still further embodiment.
Figure 11:
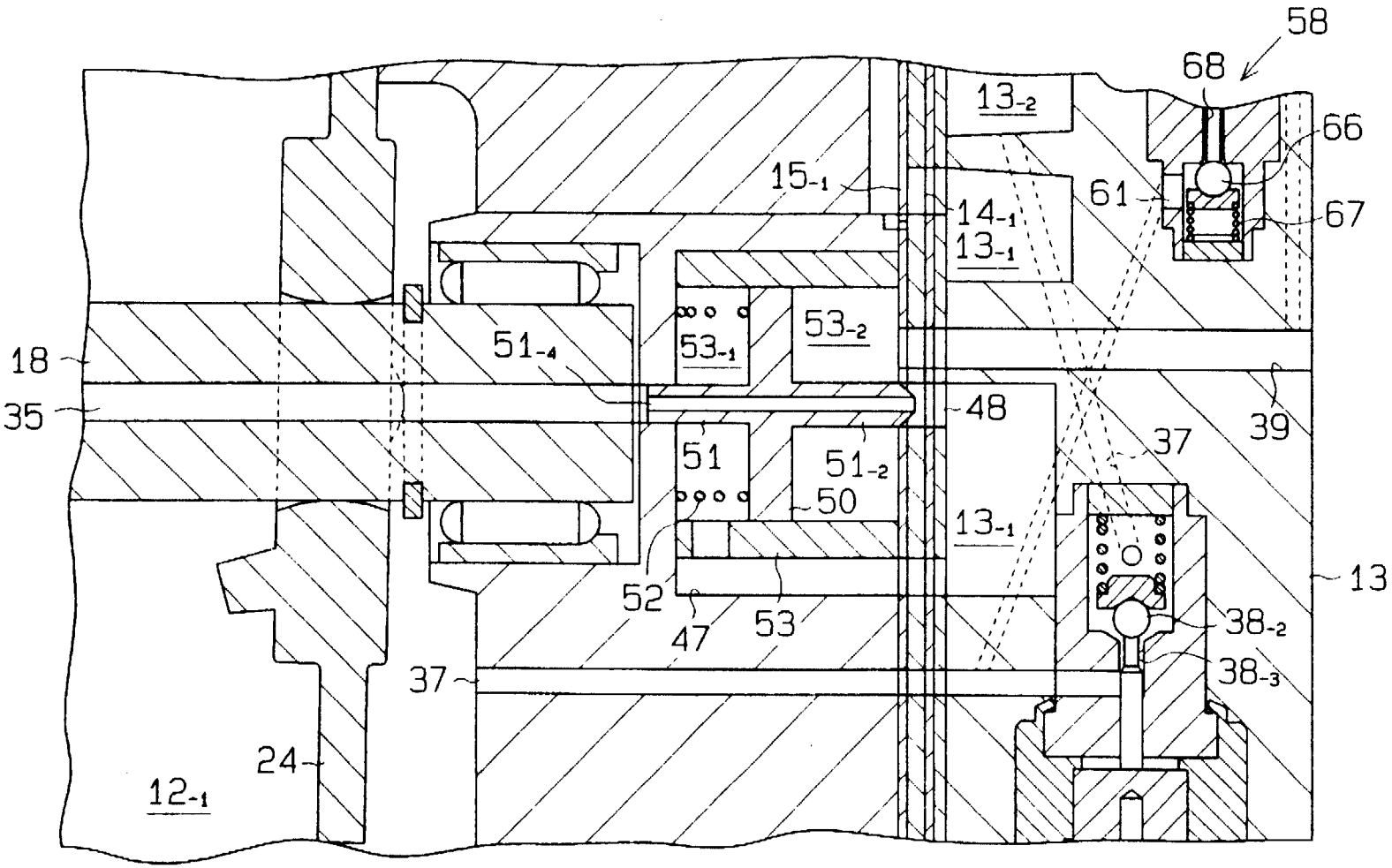
FIG. 11 is a side cross-sectional view of the essential parts of the compressor whose swash plate is at the minimum inclined angle.

An embodiment illustrated in FIGS. 10 and 11 will be now described. In this embodiment, the pressure in the crank chamber 12-1 is controlled by a displacement control valve 58. The control valve 58 has a pressure leading port 59 which communicates with the discharge chamber 13-2 and a suction pressure leading port 60 which communicates with the suction passage 39. A pressure supply port 61 communicates with the pressure supply passage 37. The pressure in a suction-pressure detecting chamber 62, which communicates with the port 59, is applied to one side of a diaphragm 63, and the elastic force of an adjusting spring 64 is applied to the other side of the diaphragm 63. The spring force of the adjusting spring 64 is transmitted to a valve body 66 via the diaphragm 63 and a rod 65. The valve body 66 which receives the elastic force of a return spring 67 opens or closes a valve hole 68 in accordance with a change in the suction pressure in the suction-pressure detecting chamber 62 to respectively permit or block the communication between the port 59 and the port 61.

The other structure is the same as that of the embodiment shown in FIG. 7, except that no restriction function is given to the passage in the valve body 50 of the open/close mechanism 49.

When the suction pressure is high (the cooling load is large) while the solenoid 38-1 of the electromagnetic valve 38 is excited and the pressure supply passage 37 is closed, the amount of opening of the valve body 66 of the displacement control valve 58 becomes smaller, reducing the amount of the refrigerant gas flowing into the crank chamber 12-1 from the discharge chamber 13-2. As a result, the pressure in the crank chamber 12-1 falls to increase the inclination of the swash plate. When the suction pressure is low (the cooling load is small), on the other hand, the amount of opening of the valve body 66 becomes larger, increasing the amount of the refrigerant gas flowing into the crank chamber 12-1 from the discharge chamber 13-2. Consequently, the pressure in the crank chamber 12-1 rises to reduce the inclination of the swash plate. That is, the discharge displacement is controlled variably and continuously.

When the electromagnetic valve 38 is de-excited, the valve body 50 of the open/close mechanism 49 closes the port 48, and when the electromagnetic valve 38 is excited, the valve body 50 opens the port 48, as in the embodiment shown in FIG. 7. This embodiment can accomplish the suppression of the switching-oriented shocks at the time the circulation of the refrigerant gas stops or starts while continuously executing the variable control of the discharge displacement.

Figure 12:
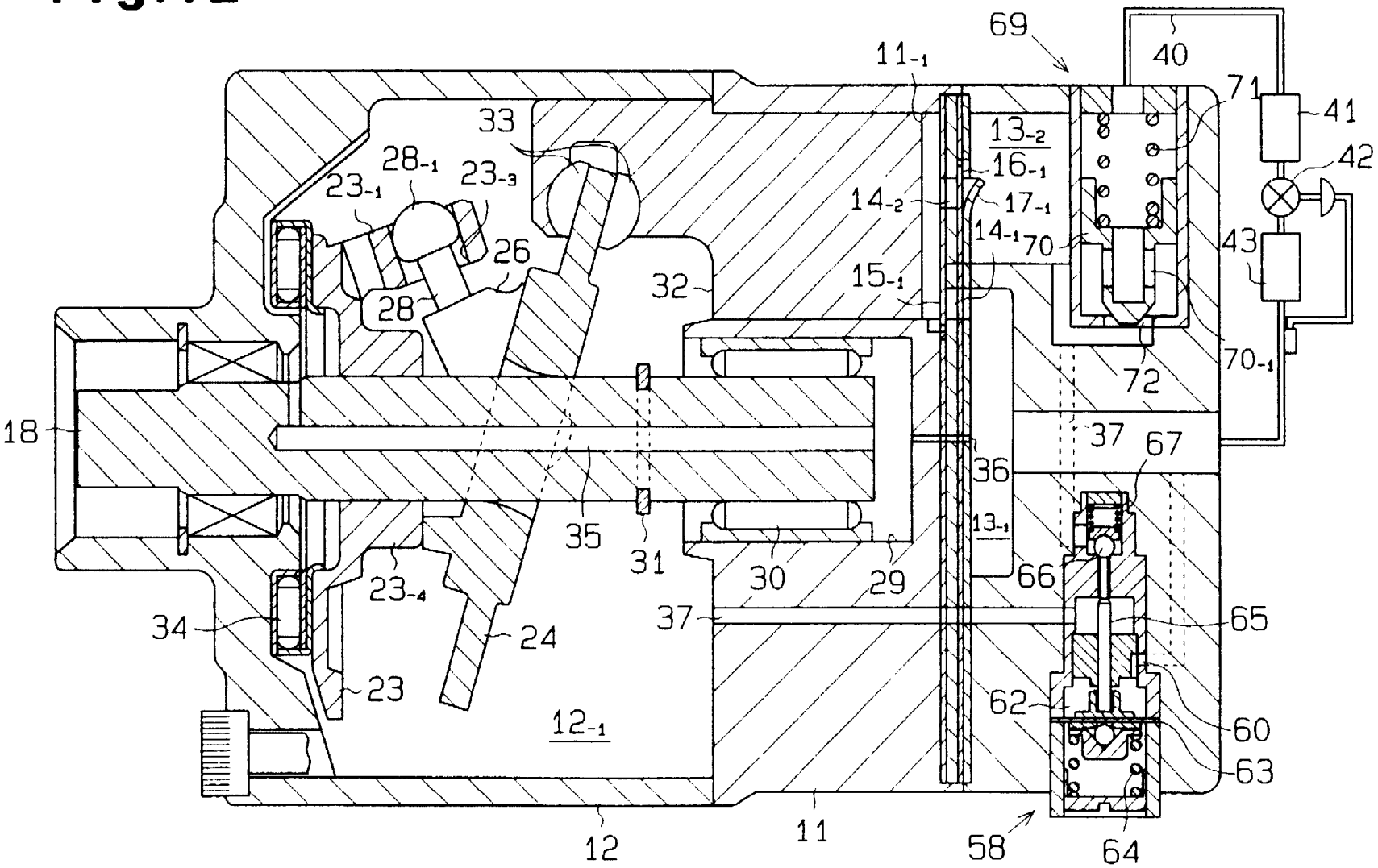
FIG. 12 is a side cross-sectional view showing the overall structure of a variable displacement compressor with a clutch according to yet another embodiment.

An embodiment illustrated in FIG. 12 will be now described. The compressor according to this embodiment is a variable displacement compressor with a clutch, which has a displacement control valve 58 attached to the rear housing 13. The displacement control valve 58 continuously performs the variable control of the inclination of the swash plate as in the embodiment shown in FIG. 10.

Intervened in the discharge passage in the rear housing 13 is an open/close mechanism 69 whose valve body 70 is urged in the direction to close a valve hole 72 by the elastic force of an adjusting spring 71. A through hole 70-1 is formed in the valve body 70. The valve body 70 closes the valve hole 72 when the pressure acting on the valve body 70 from the direction of the discharge chamber 13-2 becomes equal to or smaller than a set value which is slightly higher than the pressure in the crank chamber 12-1 needed to shift the swash plate 24 to the minimum inclination angle from the maximum inclination angle. When the pressure acting on the valve body 70 from the direction of the discharge chamber 13-2 exceeds the set value, the valve body 70 opens the valve hole 72. That is, when the differential pressure between the upstream and downstream sides of the valve body 70 falls to or below a certain set level, the valve hole 72 is closed, and when this differential pressure exceeds the certain set level, the valve hole 72 is opened.

Without the open/close mechanism 69, when the inclination angle of the swash plate is shifted to the minimum inclination angle from the maximum inclination angle, most of the refrigerant gas discharged to the discharge chamber 13-2 flows out to the external refrigeration circuit 40. When the inclination of the swash plate becomes small or when the discharge pressure becomes very low, therefore, the pressure in the crank chamber 12-1 does not rise and the inclination angle of the swash plate does not smoothly shift toward the minimum inclination side. According to this embodiment, however, when the inclination angle of the swash plate moves to the minimum inclination side, the open/close mechanism 69 is closed, causing the pressure in the crank chamber 12-1 to surely rise. This ensures the smooth transition of the inclination angle of the swash plate toward the minimum inclination side from the maximum inclination side and thus accomplishes surer displacement control. When the inclination angle of the swash plate is the minimum, the open/close mechanism 69 is closed, and thus no frosting occurs in the evaporator 43. It is possible to avoid the frequency ON/OFF actions of the electromagnetic clutch in the low-load operation, thus preventing the torque from changing by the ON/OFF action of the electromagnetic clutch. Further, because the opening/closing of the open/close mechanism 69 is executed in accordance with a change in pressure in the discharge chamber 13-2, the opening/closing of the valve hole 72, unlike in the electromagnetic opening/closing, is not the ON/OFF action and the cross-sectional area of the valve hole 72 through which the refrigerant gas passes changes gradually. Accordingly, the discharge pressure gradually changes to prevent the load torque in the compressor from changing significantly.

Figure 13:
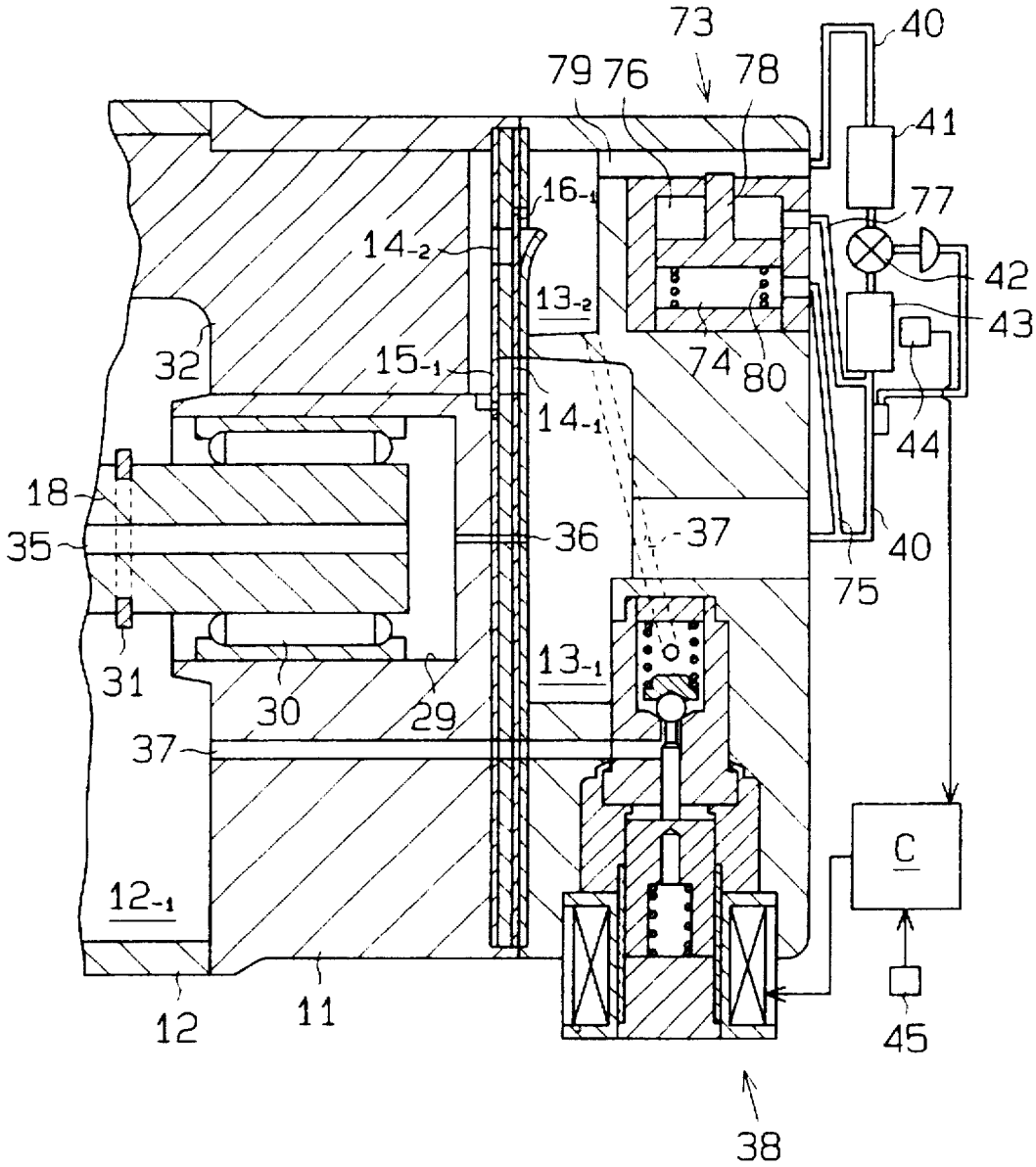
FIG. 13 is a side cross-sectional view of the essential parts of yet another embodiment.

An embodiment illustrated in FIG. 13 will be now described. In this embodiment, a compression-sensing chamber 74 in an open/close mechanism 73 communicates via a pressure leading pipe 75 with the external refrigeration circuit 40 located downstream the evaporator 43. A leading chamber 76 communicates via a pressure leading pipe 77 with the external refrigeration circuit 40 located upstream the position where the pressure leading pipe 75 is connected to the external refrigeration circuit 40. A valve body 78 of the open/close mechanism 73 opens or closes a discharge passage 79. An adjusting spring 80 urges the valve body 78 in the direction to close the discharge passage 79.

The pressure at the position where the pressure leading pipe 77 is connected to the external refrigeration circuit 40 is higher than the pressure at the position where the pressure leading pipe 75 is connected to the external refrigeration circuit 40, and the differential pressure therebetween varies in accordance with a change in the circulating refrigerant gas. This embodiment also performs the opening/closing of the open/close mechanism 73 in accordance with the amount of the circulating refrigerant gas, and can have the advantage of suppressing the switching-oriented shocks as in the first embodiment.

Although seven embodiments of the present invention have been described herein, it should be apparent to those skilled in the art that the present invention may be embodied in many other specific forms without departing from the spirit or scope of the invention. Particularly, it should be understood that this invention may be embodied in the following forms.

This invention may be adapted for other types of variable displacement compressors which supply the pressure to the control pressure chamber from the discharge pressure area and discharges the pressure to the suction pressure area from the control pressure chamber to vary the displacement.

The open/close mechanism may instead be provided in the external refrigeration circuit outside the compressor.

Therefore, the present examples and embodiments are to be considered as illustrative and not restrictive and the invention is not to be limited to the details given herein, but may be modified within the scope of the appended claims.

What is claimed is:

1. A displacable compressor including a swash plate tiltably mounted on a rotary shaft in a crank chamber to reciprocally drive a piston in a cylinder bore, said piston compressing fluid supplied to the cylinder bore from a fluid passage through a suction passage and discharging the compressed fluid to the fluid passage through a discharge passage, wherein the difference between the pressures in the crank chamber and the cylinder bore is selectively increased and decreased in accordance with pressure in the crank chamber to tilt the swash plate between minimum and maximum angles, said compressor comprising:

means for determining an amount of the fluid passing through one of the suction passage and the discharge passage to be minimum based on the compression load of said compressor;

means for forcibly tilting the swash plate toward the minimum angle in response to an instruction from the determining means;

means for regulating the tilting movement of the swash plate as it tilts to the minimum angle, said swash plate at the minimum angle being inclined toward the maximum angle with respect to a plane perpendicular to said rotary shaft to allow the passage of the minimum amount of the fluid in one of the passages; and means disposed in one of said suction passage and said discharge passage to close said one of the passages upon the passage of the minimum amount of the fluid therein.

2. The compressor as set forth in claim 1 comprising:

means for detecting the compression load of the compressor, wherein said detecting means transfers a signal based on the detected compression load to the determining means.

3. The compressor as set forth in claim 1, wherein said fluid passage has a first location and a second location to define a length portion therebetween, and wherein said closing means is disposed in the length portion to close said one of the suction passage and said discharge passage based on a difference between pressures at the first location and the second location.

4. The compressor as set forth in claim 1, further comprising:

said crank chamber being connected to one of the suction passage and the discharge passage, whereby the pressure in the crank chamber in communication with the discharge passage and suction passage respectively increases and decreases, and said tilting means includes an electromagnetic valve disposed between the crank chamber and the discharge passage to connect the crank chamber with the discharge passage upon the instruction of the determining means.

5. The compressor as set forth in claim 2, wherein said detecting means detects the compression load of the compressor based on a temperature in the fluid passage.

6. The compressor as set forth in claim 2, wherein said fluid passage has a first location and a second location to define a length portion therebetween, and wherein said closing means is disposed in the length portion to close said one of the suction passage and said discharge passage based on a difference between pressures at the first location and the second location.

7. The compressor as set forth in claim 4 further comprising:

means for detecting the compression load of the compressor, wherein said detecting means transfers a signal based the detected compression load to the determining means.

8. The compressor as set forth in claim 7, wherein said detecting means detects the compression load of the compressor based on a temperature in the fluid passage.

9. A displacement type compressor comprising:

a suction portion;

a discharge portion;

a fluid passage connecting only said suction portion and said discharge portion, wherein fluid introduced to said fluid passage from said suction portion is compressed as it is conveyed to the discharge portion and the compressed fluid is discharged from said discharge portion to said fluid passage, the pressure of the fluid in said fluid passage varying along said fluid passage;

said fluid passage including a first location and a second location located downstream of said first location, wherein the differential pressure between said first location and said second location decreases in accordance with a decreasing amount of only the fluid flowing in said fluid passage;

an open/close mechanism disposed in said fluid passage for selectively opening and closing said fluid passage in response to said differential pressure; and a valve for actuating said open/close mechanism to close the fluid passage gradually as said differential pressure becomes less than a predetermined magnitude.

10. The compressor as set forth in claim 9, wherein said first location is located upstream of said open/close mechanism and said second location is located downstream of said valve.

11. The compressor as set forth in claim 10, wherein said open/close mechanism is disposed in said suction portion.

12. The compressor as set forth in claim 10, wherein said open/close mechanism is disposed in said discharge portion.

13. The compressor as set forth in claim 9 further comprising means for minimizing displacement of the compressor, wherein fluid flow is decreased in the fluid passage as the valve actuates the open/close mechanism to close the fluid passage.

14. The compressor as set forth in claim 13, wherein said first location is located upstream of said open/close mechanism and said second location is located downstream of said valve.

15. The compressor as set forth in claim 13, wherein said open/close mechanism is disposed in said suction portion.

16. The compressor as set forth in claim 13, wherein said open/close mechanism is disposed in said discharge portion.

* * * * *